US005701837A

United States Patent [19]

Harvey

[11] Patent Number: 5,701,837

[45] Date of Patent: Dec. 30, 1997

[54] BOAT DOCK BUMPER

[76] Inventor: Thomas E. Harvey, 615 S. Main St., Bluffton, Ohio 45817

[21] Appl. No.: 691,517

[22] Filed: Aug. 2, 1996

[51] Int. Cl.[6] ..... B63B 59/02

[52] U.S. Cl. ..... 114/219

[58] Field of Search ..... 114/343, 361, 114/219; 405/212, 215; 267/139, 140

[56] References Cited

U.S. PATENT DOCUMENTS

| | | | |
|---|---|---|---|
| 2,117,121 | 5/1938 | Urquhart et al. . | |
| 3,000,021 | 9/1961 | Lang . | |
| 3,225,731 | 12/1965 | McCulley | 114/219 |
| 4,940,009 | 7/1990 | Keithley, Jr. | 114/361 |
| 5,013,272 | 5/1991 | Watkins . | |
| 5,299,521 | 4/1994 | Loucks . | |

*Primary Examiner*—Ed L. Swinehart
*Attorney, Agent, or Firm*—George C. Atwell

[57] ABSTRACT

A boat dock bumper is provided for protecting the hull of a watercraft when the watercraft is moored to a dock, pier, piling, or like structure, and includes a flexible, generally rectangular-shaped member attachable to the watercraft, a flexible upper portion for resting on the gunwale of the watercraft, and a deformable major body portion which can be conformably positioned contiguous to the hull of the watercraft. Disposed within and extending through the rectangular-shaped member from the upper portion to the major body portion are a plurality of flexible, bendable, elongated batten members which provide support and stability for the rectangular-shaped member when the boat dock bumper is attached to the watercraft.

8 Claims, 3 Drawing Sheets

BOAT DOCK BUMPER

BACKGROUND OF THE INVENTION

The present invention relates to boat accessories, and more particularly pertains to a boat dock bumper attachable to watercraft, especially to recreational watercraft, for protecting both the watercraft and the dock, pier, piling, or like structure, to which the watercraft is moored.

The growth in popularity over the last several decades of recreational boating has been accompanied by the design, production, and sale of countless accessories to enhance the appearance, improve the performance, and increase the useful life of the wide variety of watercraft available to the public. One kind of accessory which every boater includes with his or her gear is a boat bumper or boat fender.

The purpose of a boat fender or bumper is to protect the hull and gunwale of any kind of watercraft from being damaged when moored to a dock, pier, piling, or similar structure. Secondarily, the boat bumper or fender protects the dock, pier, or like structure from being damaged by the moored watercraft.

When watercraft, including but not limited to bass boats, speedboats, and recreational cruisers, are not disposed for sail and movement upon a body of water, they are secured by cables, ropes, or the like, to a dock or pier; the watercraft are moored or anchored to a natural or man-made structure which projects out from the land and into the body of water. Although the dock or pier is normally stationary and embedded in the bottom of the body of water adjacent the shoreline, docks or piers are sometimes supported by floats whereupon the docks or piers move up and down on the water's surface concomitant with the movement of the waves.

However, watercraft anchored to any kind of dock or pier does not remain stationary but floats up and down and back and forth in the water while banging, bumping, and rubbing up against the adjacent dock or pier. As the frequency and amplitude of the waves increases, the pitching and rolling of the watercraft intensifies, and, thus, the likelihood of the watercraft being damaged by banging against the dock is increased.

Therefore, to protect both watercraft and the dock from being damaged, a wide variety of boat fenders and bumpers have been designed and sold as a necessary accessory for the serious boater.

Boat fenders or bumpers can be in the form of a cylindrical, elongated tube, rounded at both ends and filled with either air or a closed-cell foam inner core to cushion and absorb the shock of constant contact of the watercraft bumping and banging against the dock. This type of boat bumper has a nylon cord at its upper end which is tied to a cleat on the gunwale of the watercraft. The boat bumper simply hangs down from the gunwale alongside the hull of the watercraft. The obvious disadvantage of this type of boat bumper is that as the watercraft pitches and rolls on the water adjacent the dock, the boat bumper does not stay in place and is turned sideways or lifted up by the waves onto the gunwale allowing the watercraft to go under the dock whereupon the watercraft can be seriously damaged.

Another type of boat bumper or fender in current use is an L-shaped boat fender designed especially for low freeboard watercraft such as fishing boats and ski boats. This type of boat fender includes a large cylindrical portion which hangs down from the gunwale alongside the hull of the boat and an integrally attached neck portion. The large cylindrical portion is air-filled or filled with a closed-cell foam inner cushion and the neck portion includes an aperture through which a nylon cord is inserted for attaching the neck portion to a cleat on the gunwale of the boat.

There are a number of disadvantages to the L-shaped boat bumper. Since the profile or contour of each respective make or model of boat may vary, the L-shaped boat bumper can only fit certain boats. Second, the width of boat gunwales also varies and the neck portion may not be long enough to properly set on the gunwale. In addition, the cleats on some boats may set four inches inward on the gunwale and the neck portion may not be able to reach the cleats. Because the L-shaped bumper hangs freely alongside the boat hull, the L-shaped bumper will not stay in place and will be displaced by rough water. The L-shaped bumper will then come up on the gunwale leaving the boat unprotected from banging against or going under the dock.

In addition to the above common boat fenders and bumpers, the prior art discloses a number of variations of boat bumpers and fenders which includes the Urquhart et al. Ship Fender for tugboats (U.S. Pat. No. 2,117,121); the Lang Combination Boat Fender and Boat Step (U.S. Pat. No. 3,000,021); the Watkins Rafting Cushion (U.S. Pat. No. 5,013,272); and the Loucks Bumper Protection For a Watercraft (U.S. Pat. No. 5,299,521). However, the boat fenders or bumpers disclosed in the above patents are subject to the same problems as previously described; and, furthermore, none of the boat fenders or bumpers disclosed in the above patents are capable of staying in place and conforming to the contour or profile of the wide variety of available watercraft.

SUMMARY OF THE INVENTION

The present invention comprehends a flexible and deformable boat dock bumper for attachment to the gunwale of a watercraft so that the boat dock bumper conforms to, and is contiguous to, the contour or profile of the watercraft hull.

The boat dock bumper of the present invention includes a generally rectangular-shaped flexible and deformable member of uniform thickness for disposition contiguous to the gunwale and the hull of the watercraft. More specifically, the rectangular-shaped member includes a flexible upper portion comprising a central cut-out section and opposed flange portions. The flange portions are bent so they rest contiguous to the gunwale so a cleat on the gunwale can project through the cut-out section. In addition, the rectangular-shaped member includes a flexible and deformable major body portion integrally attached to the upper portion and which is conformable to the profile or contour of the watercraft hull so that the major body portion can be disposed contiguous thereagainst. The major body portion is also capable of shape retention so that the major body portion maintains its contiguous conformity to the watercraft hull.

In order to provide structural support and stability for the rectangular-shaped member, a plurality of elongated, spaced-apart batten members are disposed within the rectangular-shaped member. The batten members are flexible and bendable yet are capable of shape retention after they are flexed to a particular configuration, and extend from the upper portion to the major body portion.

The major body portion has a centrally located aperture located immediately beneath the cut-out section and through which nylon cord is passed for tying or wrapping around a cleat on the gunwale.

It is an objective of the present invention to provide a boat dock bumper which is resilient, water resistant, lightweight and easy to store and transport.

It is another objective of the present invention to provide a boat dock bumper which can conform to the profiles or contours of a wide variety of watercraft hulls.

Yet another objective of the present invention is to provide a boat dock bumper which will maintain its shape in conformity to the hull contour or profile after it is disposed contiguous thereto.

These and other objects of the invention will become clear from an inspection of the detailed description of the invention, the accompanying figures, and the appended claims.

DETAILED DESCRIPTION OF THE PREFERRED EMBODIMENT

Figure 1:
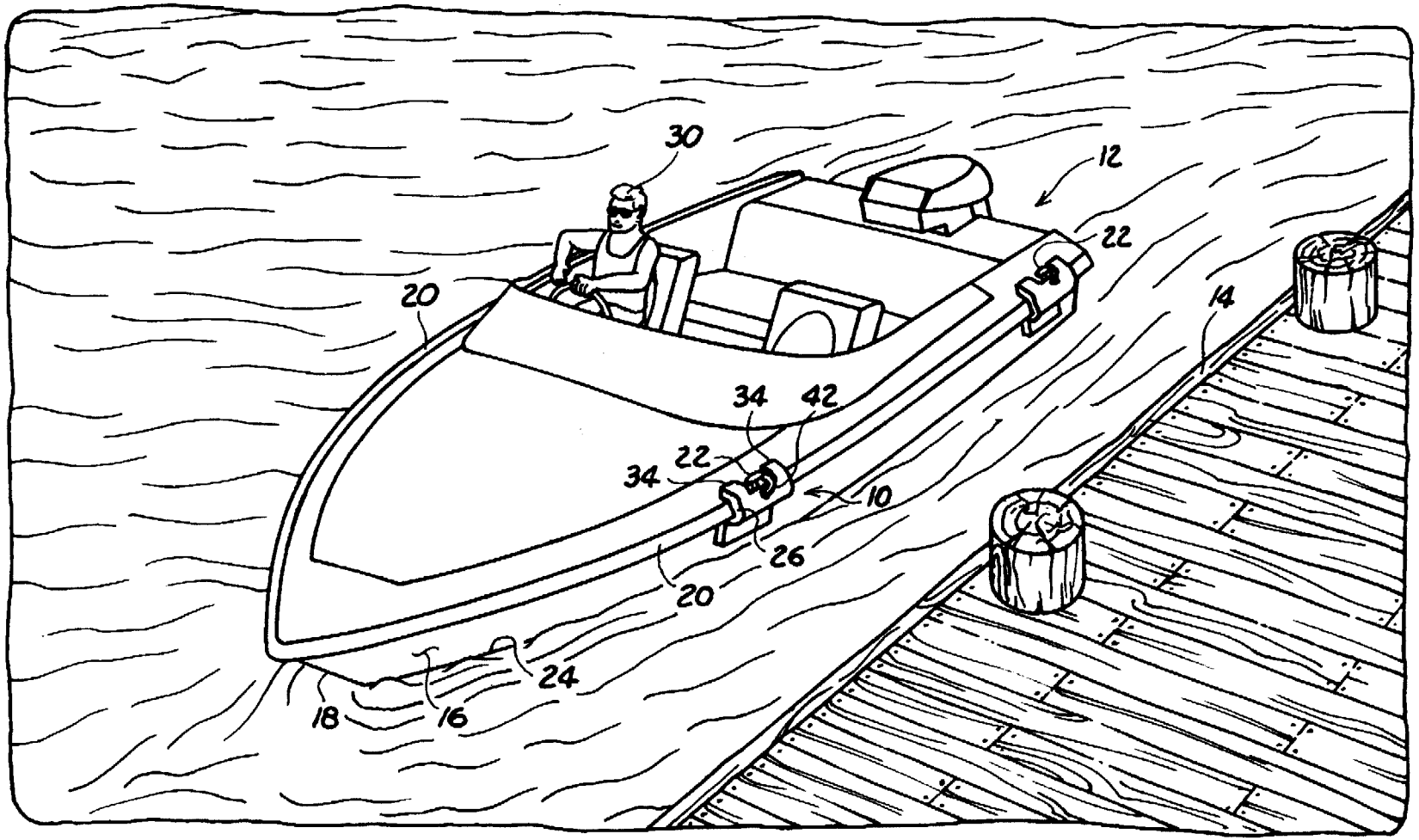
FIG. 1 is a perspective view of the boat dock bumper disposed in its use position of attachment to a watercraft.

Illustrated in FIGS. 1–11 is a boat dock bumper 10 for protecting a boat or watercraft 12 when the watercraft 12 is moored to a dock 14, pier, or similar structure. The boat dock bumper 10 is removably attachable to a wide variety of watercraft, with an emphasis on pleasure craft, including but not limited to bass boats, speedboats, and cabin cruisers. The bumper 10 is readily flexible and deformable so that it conforms to the contour or profile of an outer surface 16 of a hull 18 of the watercraft 12; and the bumper 10 is also capable of shape retention so that the bumper 10 maintains its conformable disposition contiguous to the surface 16. The purpose of the bumper 10 is to protect the watercraft 12, and especially the hull 18, as the watercraft 12 pitches and sways in the water adjacent the dock 14. Protecting the surface 16 from damage by bumping or banging against the dock 14 is a critical factor in maintaining the integrity and usefulness of the watercraft 12.

Figure 5:
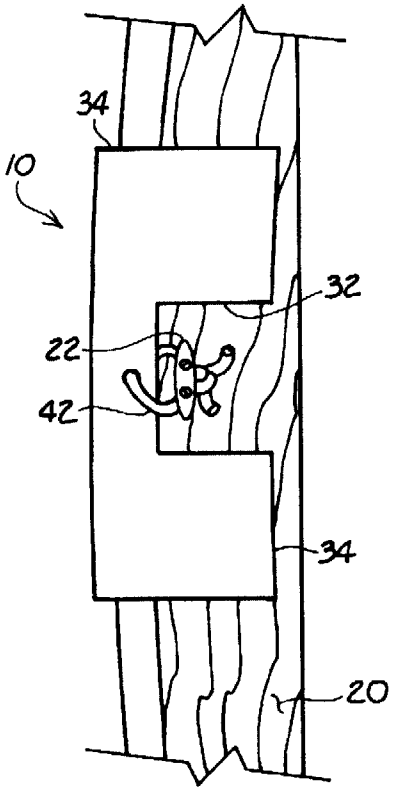
FIG. 5 is a top plan view of the boat dock bumper showing the manner of attachment of the boat dock bumper to a cleat on the gunwale of the watercraft.
Figure 4:
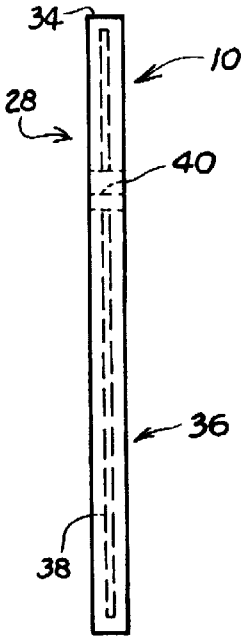
FIG. 4 is a side elevational view of the boat dock bumper showing internal structural members in hidden line.
Figure 3:
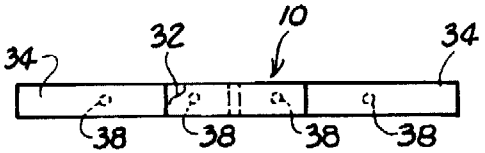
FIG. 3 is a top plan view of the boat dock bumper first shown in FIG. 1.

As shown in FIGS. 1–5, the boat dock bumper 10 is attached to a gunwale 20 and conforms to the surface 16 adjacent the gunwale 20. The gunwale 20 forms a continuous upper edge for the hull 18. Watercraft, such as those used for pleasure boating, include a plurality of spaced-apart cleats secured to the gunwale and projecting upwardly therefrom. The cleats are metal T-shaped members around which ropes, cables, nylon cords, and the like, can be tied when mooring a boat to a dock and also for securing a boat bumper or fender to the gunwale 20. The representative watercraft 12 in FIG. 1 includes two spaced-apart cleats 22 on both the windward and the leeward sides of the watercraft 12. As shown in FIGS. 1 and 5, a portion of the bumper 10 is superposed on the gunwale 20 while the remainder of the bumper 10 is pendent from the gunwale 20 for disposition contiguous to the surface 16. The bumper 10 does not need to extend downwardly along the surface 16 to the water line 24 in order to protect the hull 18 from being damaged by bumping and banging against the dock 14.

As illustrated in FIGS. 1–5, the bumper 10 includes and is formed from a generally rectangular-shaped member 26 of uniform thickness and which is flexible and deformable in order to be placed contiguous to the surface 16. The member 26 is manufactured from a hard, resilient, durable rubber which is generally resistant to gouging or tearing upon contacting the dock 14, and yet can absorb continuous blows against a hard, unyielding surface, such as the dock 14. Once the bumper 10 is attached to the gunwale 20 and is disposed contiguous to the hull 18, the member 26 has the capability of shape retention in that the member 26 maintains its contiguous conformity to both the gunwale 20 and the surface 16 and does not hang loosely from the gunwale 20. The member 26 has a flexible and bendable upper portion 28 which is bent by a boater 30 so that the upper portion 28 is superposed on the gunwale 20 and is then wrapped partially around the gunwale 20 while maintaining contiguous contact thereagainst. The upper portion 28 includes a central cut-out section 32 and opposed flange portions 34. The flange portions 34 rest on the gunwale 20 while the section 32 permits the flange portions 34 to lay on either side of the cleat 22. The flange portions 34 are flexible and bendable and will retain their shape once the flange portions 34 are superposed on and wrapped partially around the gunwale 20.

As shown in FIGS. 1–5, the member 26 also includes a major body portion 36 which is integrally attached to the upper portion 28. The body portion 36 is flexible and deformable so that it can be bent to conform to the profile of the hull 18. Like the upper portion 28, the body portion 36 is capable of shape retention so that the body portion 36 will maintain its conformity to the profile or contour of the hull 18. When disposed in its operative position, the body portion 36 will also be contiguous to the surface 16. The body portion 36 will act as a cushion to absorb the blows of the watercraft 12 bumping and banging against the dock 14, and the body portion 36 will retain its shape during such contact.

As shown in FIGS. 1–5, a deformable means is provided for allowing the member 26 to flex and readily deform to a number of different configurations so that the member 26 can be disposed contiguous to the gunwale 20 and surface 16 while at the same time providing support and stability for shape retention once the member 26 is disposed in its use position on the watercraft 12. The deformable means of the present invention is a plurality of elongated batten members completely disposed within the member 26 and longitudinally through the body portion 36. In the present invention, four spaced-apart batten members 38 are used and, when the member 26 is stretched out so that it is flat, the batten members 38 will longitudinally extend the length of the member 26. The batten members 38 provide structural support for the bumper 10 when the bumper 10 is disposed in a particular configuration contiguous to the gunwale 20 and surface 16. The batten members 38 are actually elongated wires sized to fit completely within the member 26 and having a gauge approximately the same as the diameter of a standard coat hanger wire. This type of wire is readily flexible and deformable and can be bent into various types of configurations depending upon the requirements at hand.

Figure 2:
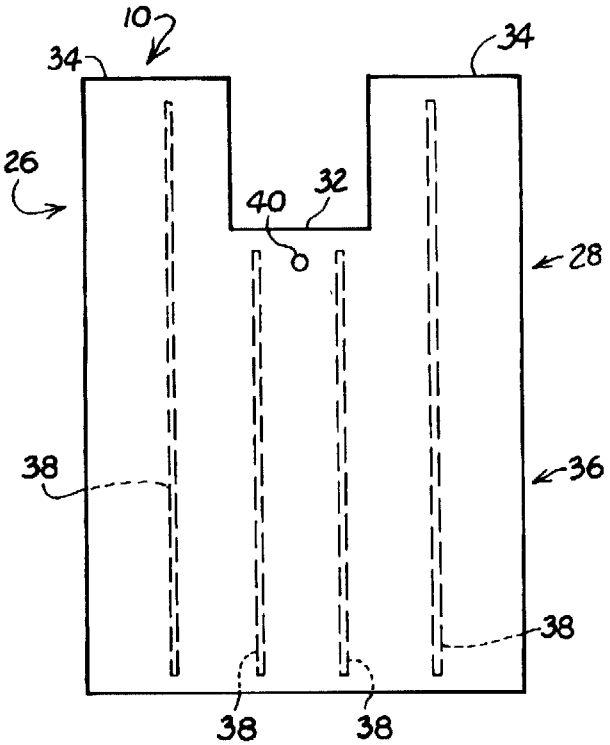
FIG. 2 is a front elevational view of the boat dock bumper illustrating internal structural members in hidden line.
Figure 8:
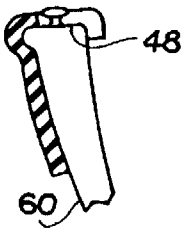
FIG. 8 is a side elevational view of the boat dock bumper disposed contiguous to a representative watercraft hull profile.
Figure 7:
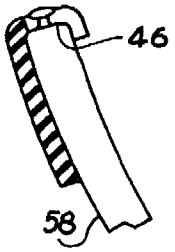
FIG. 7 is a side elevational view of the boat dock bumper disposed contiguous to a representative watercraft hull profile.
Figure 6:
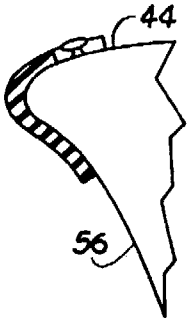
FIG. 6 is a side elevational view of the boat dock bumper disposed contiguous to a representative watercraft hull profile.
Figure 11:
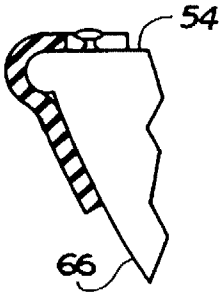
FIG. 11 is a side elevational view of the boat dock bumper disposed contiguous to a representative watercraft hull profile.
Figure 10:
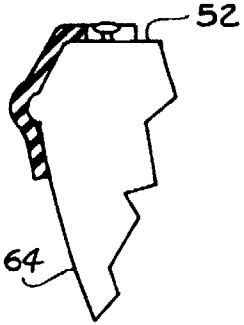
FIG. 10 is a side elevational view of the boat dock bumper disposed contiguous to a representative watercraft hull profile.
Figure 9:
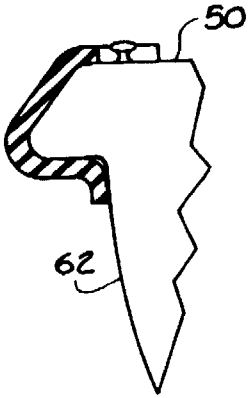
FIG. 9 is a side elevational view of the boat dock bumper disposed contiguous to a representative watercraft hull profile.

As shown in FIG. 2, the batten members 38 on the inside are shorter than the batten members 38 on the outside of the member 26 in order to accommodate the shortened length of the body portion 36 due to the positioning of the section 32. The batten members 38 incorporate the two primary characteristics of being readily flexible and deformable in order to allow the bumper 10 to be disposed contiguous against a variety of watercraft hulls while longitudinal extension of the batten members 38 provide structural support and stability for the upper portion 28 and the body portion 36 so that both portions 28 and 36 maintain their conformity to the gunwale 20 and hull 18 of the watercraft 12.

As shown in FIGS. 1–5, an attachment means is used for securing the bumper 10 to the watercraft 12. The attachment means includes a centrally-located aperture 40 extending through the body portion 36 and which is located immediately beneath the section 32. Rope 42, cable, nylon cord, and the like, as shown in FIG. 5, can be passed through the aperture 40 for tying around one cleat 22. FIGS. 6–11 illustrate the bumper 10 disposed contiguous to gunwales 44, 46, 48, 50, 52, and 54 and hulls 56, 58, 60, 62, 64, and 66 of representative watercraft having various contours or profiles. As can be readily observed, the flexibility and shape retention capability provided by the batten members 38 allows the bumper 10 to be configured contiguous to a range of watercraft hull 56–66 profiles.

In addition to the wide applicability of the bumper 10, the materials and manufacturing steps are also relatively straightforward. The member 26 is preferably composed of PVC resin, a heat stabilizer, a plasticizer (a substance which softens the final product), a chelator, and titanium dioxide, all of which are combined in varying proportions as directed by the particular requirements for each specific bumper 10. In the manufacturing process, the bumper 10 is actually manufactured as two separate units cut longitudinally so that one unit lays upon and is the mirror image of the other unit. The lower layer, as it may be called, is baked for 15 minutes at 360°. Then the batten members 38 are laid within the lower layer at a depth of approximately one-half-inch. The upper layer, as it may be called, is then laid upon the lower layer completely covering and containing therein the batten members 38, and then both layers, with the batten members 38 enclosed therebetween, are baked in an oven for 45 minutes at 360°. This step seals the batten members 38 within the member 26. The bumper is then removed from the oven having the shape and form as shown in FIGS. 1–11.

The foregoing is a description of a preferred embodiment of the invention and is not to be taken as limited to any of the specific features as described, but comprehends all such variations thereof as come within the scope of the appended claims.

I claim:

1. A boat dock bumper for attachment to the gunwale of a watercraft and which is conformable to the outer surface of the hull of the watercraft, comprising:

a generally rectangular-shaped member of uniform thickness having a bendable upper portion for resting on the gunwale and a flexible, deformable major body portion which is conformable to the outer surface of the hull so that the major body portion can be disposed contiguous thereagainst;

the upper portion having a central cut-out section and opposed flange portions;

a plurality of spaced-apart, flexible batten members disposed within the generally rectangular-shaped member and extending from the upper portion to the major body portion;

the batten members providing structural support and stability to the generally rectangular-shaped member and capable of flexible and bendable movement so that the major body portion can conform to the outer surface of the hull; and attachment means for securing the generally rectangular-shaped member to the watercraft.

2. The boat dock bumper of claim 1 wherein the generally rectangular-shaped member includes four spaced-apart, flexible batten members disposed therein and extending from the upper portion to the major body portion.

3. A boat dock bumper for attachment to the gunwale of a watercraft and which is conformable to the hull of the watercraft, comprising:

a generally rectangular-shaped member of uniform thickness having a bendable upper portion for resting on the gunwale and a flexible, deformable major body portion which is conformable to the hull so that the major body portion can be disposed contiguous thereagainst;

upper portion having a central cut-out section and opposed flange portions for resting on the gunwale;

a plurality of flexible batten members disposed within and extending through the generally rectangular-shaped member;

the batten members for providing structural support and stability to the generally rectangular-shaped member and capable of flexing so that the major body portion can be placed contiguous to the hull of the watercraft; and attachment means for securing the generally rectangular-shaped member to the watercraft.

4. The boat dock bumper of claim 3 wherein the batten members extend within the upper portion and the major body portion.

5. The boat dock bumper of claim 4 wherein the generally rectangular-shaped member includes four spaced-apart, flexible batten members disposed therein and extending within the upper portion and the major body portion.

6. A boat dock bumper for attachment to the gunwale of a watercraft, comprising:

a flexible and bendable, generally rectangular-shaped member of uniform thickness which is deformable so that the generally rectangular-shaped member can be disposed contiguous to the hull of the watercraft;

a plurality of spaced-apart, bendable batten members disposed within and extending through the generally rectangular-shaped member for providing structural support and stability to the generally rectangular-shaped member and deformable so that the generally rectangular-shaped member conforms to the hull of the watercraft;

the generally rectangular-shaped member further including a flexible and bendable upper portion for resting on the gunwale of the watercraft and a major body portion;

the upper portion characterized by a center cut-out section and opposed flange portions; and an attachment means for securing the boat dock bumper to the watercraft.

7. The boat dock bumper of claim 6 wherein the number of bendable batten members disposed within the generally rectangular-shaped member is four.

8. The boat dock bumper of claim 7 wherein at least two batten members longitudinally extend within the upper portion and the major body portion and at least two batten members longitudinally extend only within the major body portion.

* * * * *